United States Patent [19]

Miller

[11] Patent Number: 4,620,336

[45] **Date of Patent: * Nov. 4, 1986**

[54] BODY SUPPORT FOR BED OR SEAT

[75] Inventor: John E. Miller, Tupelo, Miss.

[73] Assignee: Parma Corporation, Denton, N.C.

[ * ] Notice: The portion of the term of this patent subsequent to Dec. 25, 2001 has been disclaimed.

[21] Appl. No.: 559,235

[22] Filed: Dec. 8, 1983

Related U.S. Application Data

[63] Continuation-in-part of Ser. No. 367,874, Apr. 13, 1982, Pat. No. 4,489,450.

[51] Int. Cl.[4] ..... A47C 23/02

[52] U.S. Cl. ..... 5/249; 5/250; 5/261; 5/262

[58] Field of Search ..... 5/247, 249, 250, 251, 5/252, 261, 262; 267/103–110

[56] References Cited

U.S. PATENT DOCUMENTS

| | | | |
|---|---|---|---|
| 149,758 | 4/1874 | Junge | 5/250 |
| 332,081 | 12/1885 | Jeffrey et al. | 5/249 |
| 341,246 | 5/1886 | Keenholts | 5/250 |
| 399,807 | 3/1889 | Gail | 5/250 |
| 516,195 | 3/1894 | Gail | 5/250 |
| 927,982 | 7/1909 | Klipfel | 5/249 |
| 1,285,721 | 11/1918 | Johnston | 5/250 |
| 1,554,098 | 9/1925 | Kaiserman | 5/465 |
| 2,239,877 | 4/1941 | Ciullo | 5/250 |
| 2,634,427 | 4/1953 | Wodarsky | 5/13 R |
| 2,773,270 | 12/1956 | Rozelle | 5/447 |
| 2,874,390 | 2/1959 | Stone | 5/447 |
| 2,974,326 | 3/1961 | Ross | 5/447 |
| 3,085,259 | 4/1963 | Sandor | 5/447 |
| 3,892,001 | 7/1975 | Schneider | 5/13 |
| 4,003,564 | 1/1977 | Taylor | 267/108 |
| 4,050,738 | 9/1977 | Griffiths | 267/103 |
| 4,069,525 | 1/1978 | Valoff | 5/247 |
| 4,120,058 | 10/1978 | Kitchen et al. | 267/103 |
| 4,377,279 | 3/1983 | Schulz, Jr. et al. | 5/250 |
| 4,489,450 | 12/1984 | Miller | 5/250 |

FOREIGN PATENT DOCUMENTS

| | | | |
|---|---|---|---|
| 114849 | 9/1898 | Fed. Rep. of Germany | 5/250 |
| 936219 | 9/1963 | United Kingdom . | |

*Primary Examiner*—Gary L. Smith
*Assistant Examiner*—Michael F. Trettel
*Attorney, Agent, or Firm*—William E. Mouzavires

[57] ABSTRACT

A box spring is condensed along its depth dimension and then packaged in this depressed state for storage and/or transportation. At its point of use, the box spring is unpackaged and expanded along its depth dimension for use. Within the box spring are a plurality of support springs movable from retracted, unstressed positions enabling the aforementioned compaction of the box spring, to extended positions which provide the resilient support of the box spring when placed into use. In the preferred form of the invention, the springs are made from spring wire or similar material formed into a sinusoidal shape including generally coplanar wavy or sine portions. The springs are mounted such that movement of the upper support surface of the box spring relative to the base will cause the springs to move into their extended or erect positions to provide resilient support for use of the box spring or to enable the box spring to be depressed into a compact mass for storage or shipment. Releasable means are provided to hold the box spring in its expanded, use position. In the preferred embodiment disclosed, this is achieved through the use of diagonal dies interconnected to and between diagonally opposite locations within the box spring.

53 Claims, 17 Drawing Figures

FIG. 9
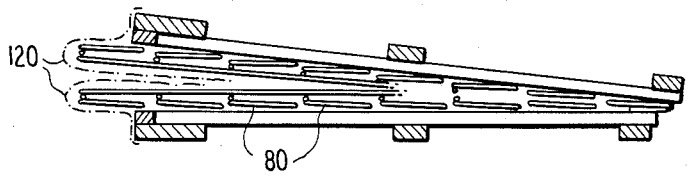
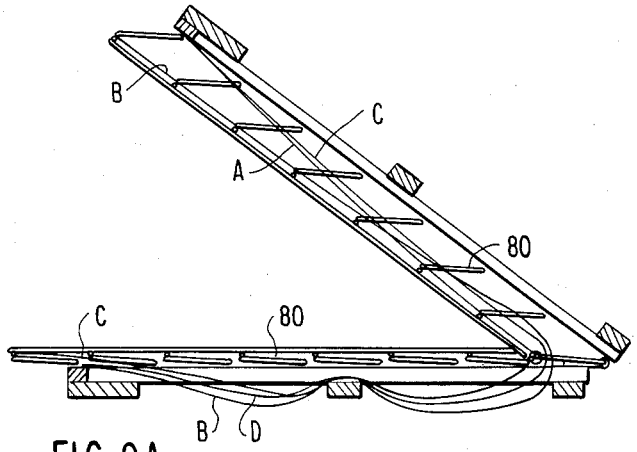
FIG. 9A
FIG. 9B
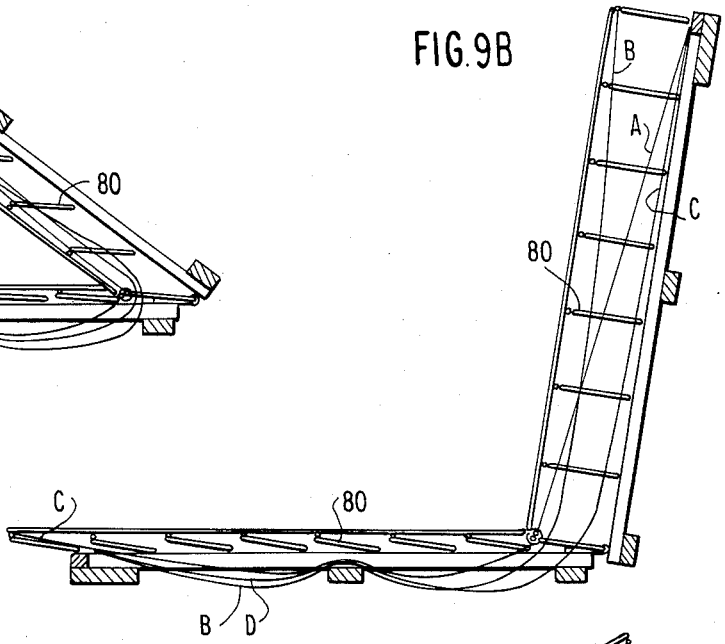
FIG. 9C
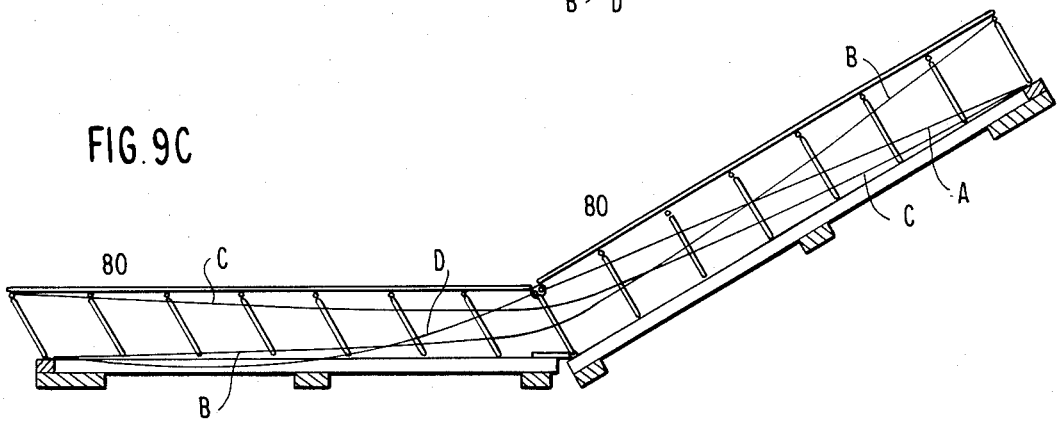
FIG. 10
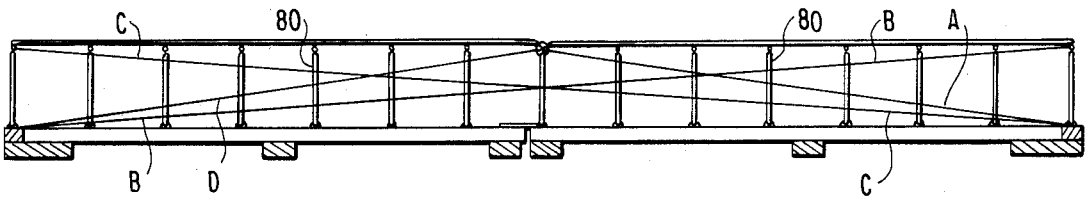

BODY SUPPORT FOR BED OR SEAT

RELATED PATENT APPLICATION

The present application is a continuation-in-part of my pending United States patent application Ser. No. 06/367,874, filed Apr. 13, 1982 and entitled "Body Support For Bed Or Seat" and which issued into U.S. Pat. No. 4,489,450 on Dec. 25, 1984. The disclosure of my aforementioned application, Ser. No. 06/367,874 is hereby incorporated by reference into the present application and made a part hereof.

BACKGROUND OF INVENTION

Box springs in use today have changed very little from those in use over the years. They include an array of coil springs enclosed in a box-like frame on whose base the springs are mounted. Although such conventional box springs have provided adequate support for a mattress, they are large and cumbersome to handle in storage and transportation or shipment, particularly from the standpoint of cost.

Moreover, it is not uncommon for a coil spring manufacturer to compress or deform coil spring units layered one on top of the other into condensed or compacted multilayered packs for shipment to the box spring manufacturer. The aforementioned step is performed by means of a press machine enabling the spring units to be compressed to reduce their dimension. The coil spring units of each pack are held in their compacted state against return to their normal or unstressed condition by means of strapping applied about the unit. The spring units of each pack being compressed, the strapping is under a great amount of tension. When the packs arrive at the place of the box spring manufacturer, it is, of course, necessary to sever the strapping around the packs in order to release the spring units for installation into the box spring. This, of course, is a dangerous step because of the high degree of tension to which the strapping is subjected by the compression of the coil springs.

As can be seen from U.S. Pat. No. 4,377,279, issued Mar. 22, 1983, one proposal has been made for providing a wire foundation unit for a box spring which unit can be shipped to the box spring manufacturer in a compact state. The manufacturer would erect the foundation wires or springs and then fix by staples, rigid struts between the wire unit and the base to permanently secure the wire unit in the erected position. The box spring manufacturing process would then be completed by providing the conventional layer of padding on the top of the wire foundation and a sheet covering or casing about the entire unit. However, once the manufacture is completed, the box spring is no longer collapsible and thus must be shipped in its expanded or full-size state to the point of retail or use whereby the same storage and shipment costs result at this point as with conventional box springs.

As will be seen below, the present invention overcomes each of the aforementioned problems.

OBJECTS OF THE PRESENT INVENTION

It is an object of the present invention to provide an improved box spring for a bed or like articles which will substantially reduce the unit costs of handling, storage and shipment thereof. Included herein is a novel method of storing a box spring for shipment or other purposes. A still further object is to provide such a novel box spring and method as described above but without sacrificing spring support or other performance of the box spring when in use.

A further object of the present invention is to provide a novel box spring that may be packaged, stored or transported prior to use in a depressed or compacted state and later expanded or erected to a use position at the point of use. Included herein is a box spring that once erected for use, display or otherwise, may be subsequently depressed into a compact state for storage, handling or shipment and then again erected for use or otherwise. Further included herein is such a box spring that may be moved between a useful position and a storage position in which the box spring depth and length dimensions have been substantially reduced.

Another object of the present invention is to provide a novel box spring that may be folded on itself into two overlying sections to decrease the length thereof for storage, handling or shipment.

A further object of the present invention is to provide a novel box spring that may be folded on itself into two overlying sections which at the same time reduces the depth dimensions of the sections. Additionally, the box spring may be subsequently unfolded to restore it to its normal state for use after which it may be again folded for storage, handling or shipment.

A still further object of the present invention is to provide a box spring incorporating extendable and retractable support members and securement means for releasably securing the support members in extended positions to enable the box spring to be placed into use. Included herein is such a box spring wherein said securement means may be easily released to permit the support members to be retracted into unstressed positions for compacting the box spring, and further wherein said securement means may be subsequently easily established to restore the box spring to its useful position. Further included herein is such securement means which may be established and released either manually or automatically.

A still further object of the present invention is to provide such a novel box spring that may be commercially manufactured in various conventional bed sizes or other sizes for consumer or other users in conventional beds or other beds.

SUMMARY OF INVENTION

A box spring according to the invention includes a plurality of support members or springs movable between a retracted or collapsed position and an extended or erected position. In their retracted positions, the springs are unstressed and lie in generally horizontal planes. Thus, the box spring is substantially reduced in its depth dimension thereby facilitating storage handling and/or shipment at reduced unit cost. In their extended positions, the springs are erect in vertical planes and thus, the box spring is ready for use. After use, the box spring may be collapsed to its storage position and then later expanded to its use position and this process may be repeated as desired.

In one preferred embodiment, the springs are pivotally mounted to a base frame of the box spring for movement between the aforementioned positions. The upper ends of the springs are pivotally attached to an upper frame, and an outer sheet-covering encloses the frame and springs. In order to keep the springs in their extended positions, releasable securement means is provided, preferably in the form of cross-ties diagonally extending between the base and upper frames. During storage, handling or shipment, the springs are retracted in unstressed condition where they extend generally horizontally in a highly compact condition with the upper frame lying relatively close to the base frame. In this condition, the box spring may be contained in a carton or by strapping. At the point of use, the box spring is simply removed from its carton and the upper and lower frames are moved relative to each other to erect the springs to their extended position where they extend in generally vertical planes or normal to the planes of the box spring frames. In this condition of the box spring, the diagonal ties are taut, and one of the diagonal ties is then fastened to the frame to thus secure the springs in their extended positions. The box spring is thus readied for use. In order to convert to the storage position, the releasable tie is released from the frame to allow relative movement between the frames causing the springs to move into their retracted positions.

In another preferred embodiment, the box spring is constructed to be foldable upon itself into two overlying sections, thus reducing the length in half for storage. This action is also used to activate the support members or springs into their retracted positions while releasing tension in the securement ties. Unfolding of the sections to place the box spring in the use mode causes the springs to erect while establishing tension in the ties to secure the springs in their erect position.

The support members or springs themselves are preferably formed by spring wire bent into non-spiral, preferably two-dimensional, shapes preferably including sinusoidal portions extending generally in the same planes.

As will be apparent, the invention may also be employed to construct mattresses as well as box springs.

DRAWINGS

Other objects of the present invention will become apparent from the following more detailed description taken in conjunction with the attached drawings in which:

FIG. 9 is a side view of a box spring constituting a second preferred embodiment of the invention shown with its padding removed and with its sections in a folded position for storage, handling or shipment;

FIGS. 9A, 9B and 9C are views similar to FIG. 9 but showing successive positions of the box spring sections as they move to the fully unfolded, use position;

Figures 11, 12, 13, 14:
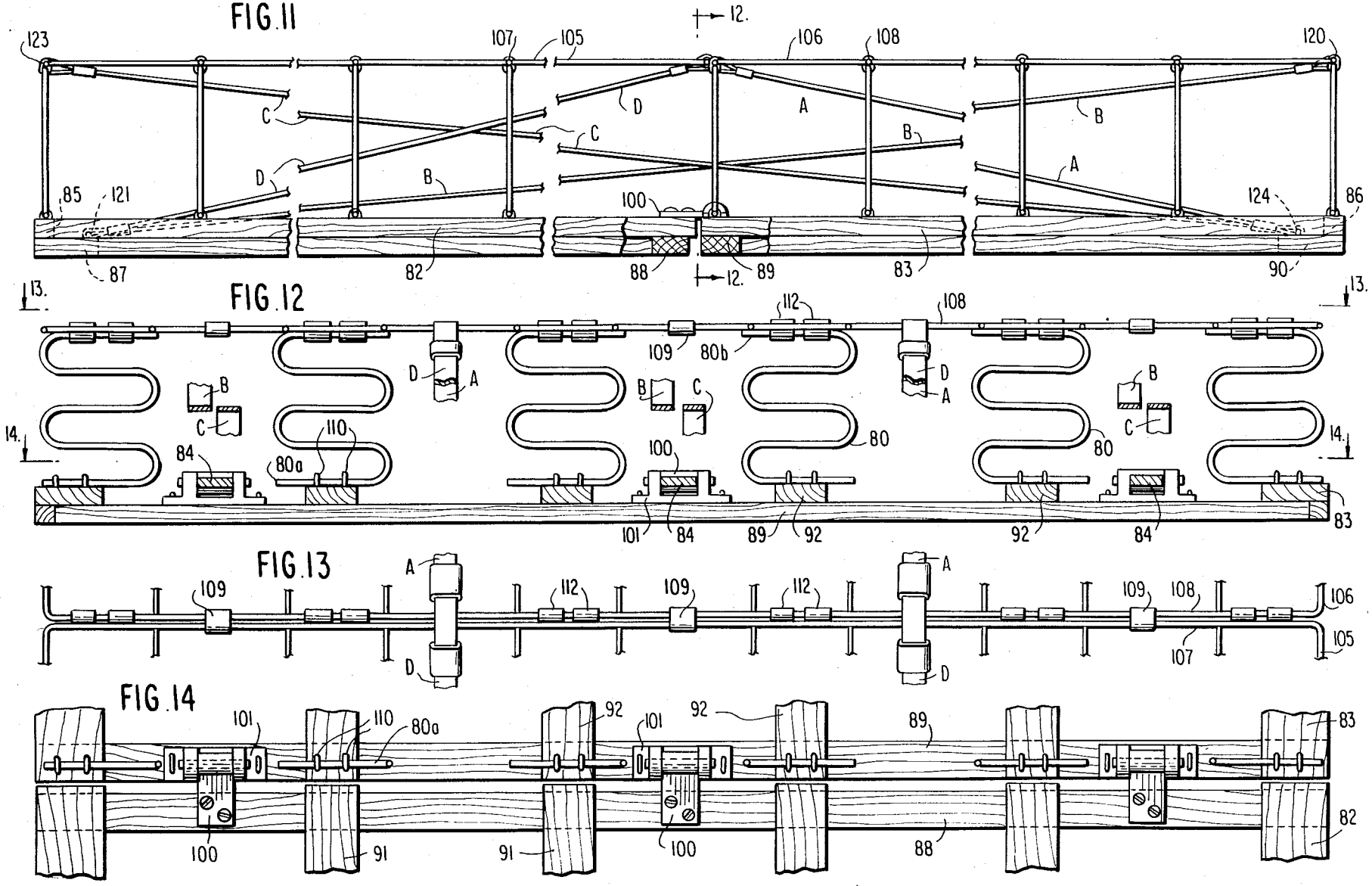

FIG. 10 a view similar to FIGS. 9, 9A, 9B and 9C but showing the box spring sections in the fully unfolded position wherein the box spring is ready for use;

FIG. 11 is a view similar to FIG. 10 but in cross section and to an enlarged scale to show more detail;

FIG. 12 is a cross-sectional view taken generally along lines 12—12 of FIG. 11;

FIG. 13 is a fragmental plan view taken generally along lines 13—13 of FIG. 12; and FIG. 14 is a cross-sectional view taken generally along lines 14—14 of FIG. 13.

DETAILED DESCRIPTION

Figure 1:
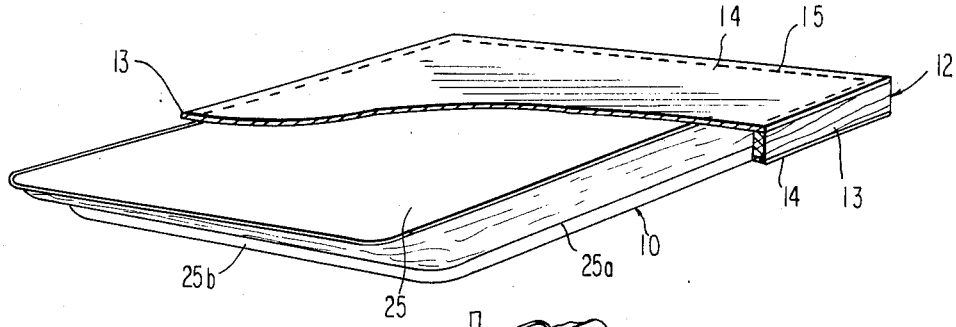
FIG. 1 is a perspective view of a box spring constituting a first preferred embodiment of the present invention shown in a collapsed or compacted state within a shipping container, the latter being broken away to show the box spring.

Referring now to the drawings in detail and initially with reference to FIG. 1, there is shown for illustrative purposes only a box spring generally designated 10 constituting a preferred embodiment of the present invention and being shown in a shipping carton generally designated 12. Carton 12 in the specific form shown includes a rectangular frame that may be formed from wood rails 14, and opposite rectangular panels 14 attached such as with staples 15 to the opposite sides of frame 13 to form a shallow enclosure for receiving the box spring 10 for purposes of storage and/or shipment. Box spring 10 is shown in FIG. 1, in its collapsed or storage position achieved through the present invention and which provides relatively speaking, a substantially reduced depth dimension to the box spring without the need of compressing springs. As will be appreciated from the entire description herein, other means in place of the carton 13 may be employed to contain or house the box spring for storage or shipment.

Figure 5:
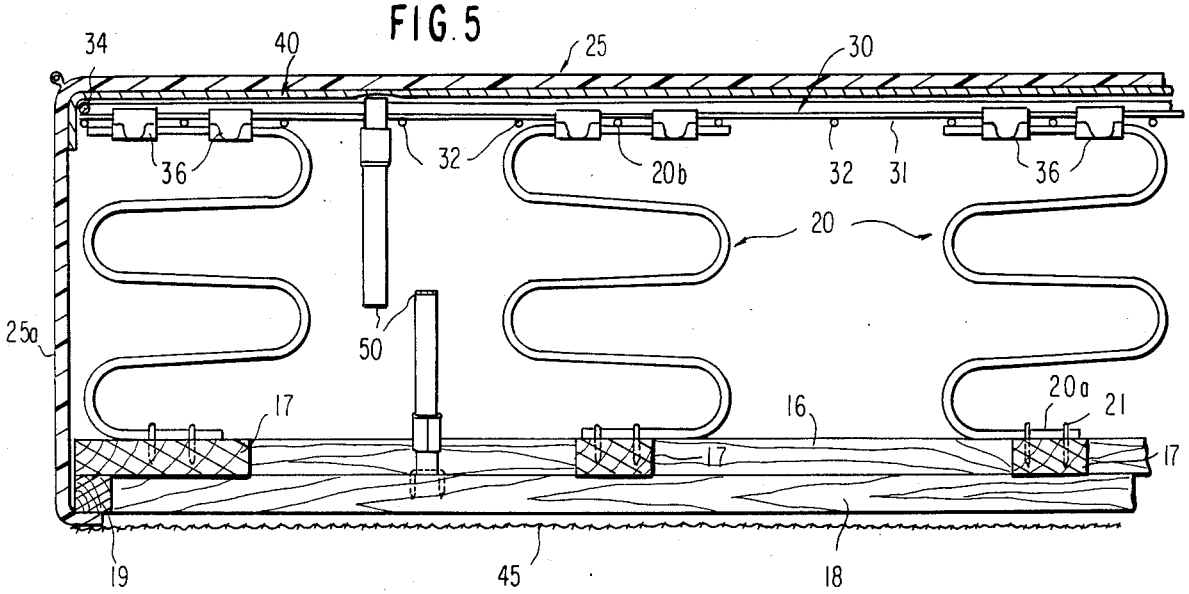
FIG. 5 is a fragmental longitudinal cross-sectional view taken at one end position of the box spring when in the expanded or use position.
Figure 6:
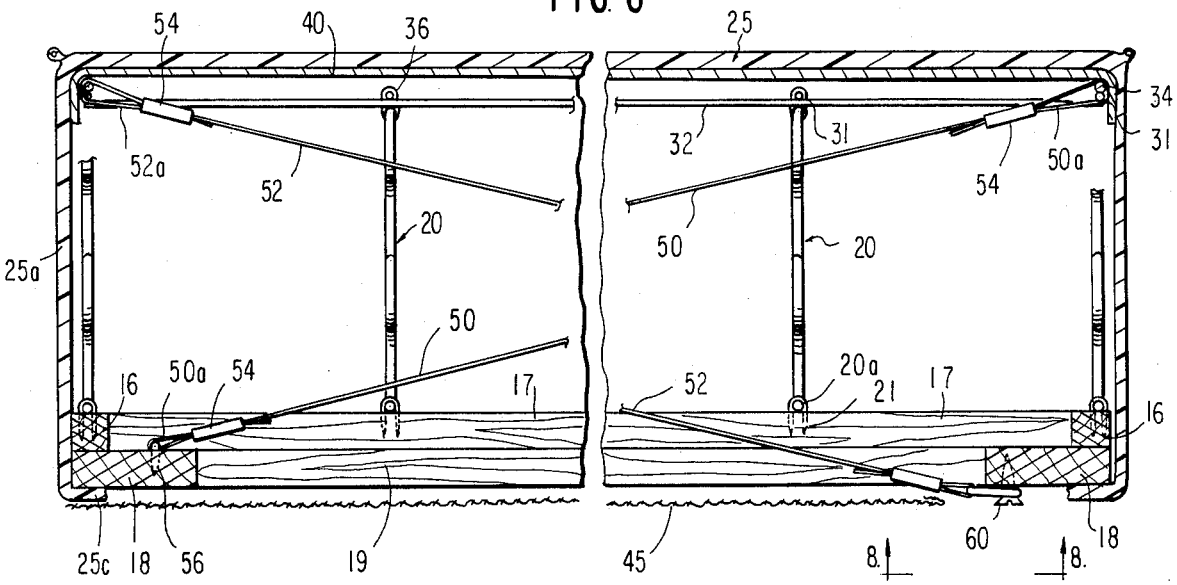
FIG. 6 is a transverse cross-sectional view of the box spring when in the expanded or use position.

Referring now to FIGS. 5 and 6 which respectively show longitudinal and cross-sectional views of the box spring 10, one preferred embodiment of the box spring includes a base that may be constructed in conventional fashion from elongated wood framing strips secured together in a rectangular configuration. The framing strips may include as shown opposite parallel side members 16 extending longitudinally and rigidly interconnected by parallel transverse members 17 extending in the same plane as members 16. The base further includes longitudinal members 18 fixed to and below members 16 in parallel thereto and opposite end members 19 fixed to and between members 18 at opposite ends thereof.

Figure 3:
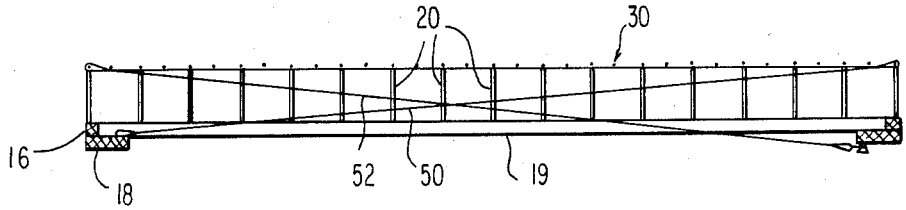
FIG. 3 is a transverse cross-sectional view in schematic of the box spring omitting outer covering sheets.
Figure 4:
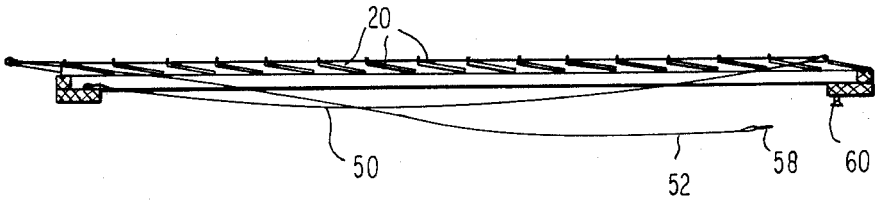
FIG. 4 is a view similar to FIG. 3 but with the box spring shown in collapsed or storage position.
Figure 8:
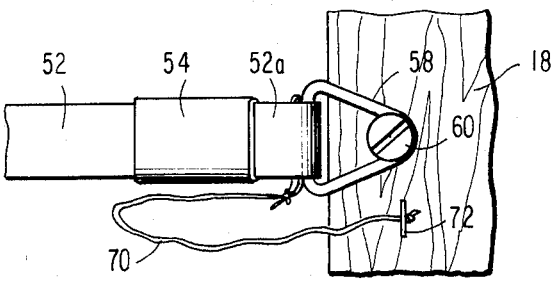
FIG. 8 is a fragmental detail view taken generally along lines 8—8 of FIG. 7.

A plurality of support members, preferably springs generally designated 20 are mounted within the box spring for movement between extended (erect) and retracted (collapsed) positions. As will become clearer, the erect positions of the springs are utilized in order to place the box spring in the useful mode where it will provide support for a mattress, cushion or other human body support. The collapsed position of the springs are utilized to compact or condense the depth dimension of the box spring to decrease space requirements for storage, handling and shipment prior to actual use of the box spring. FIGS. 1, 4 and 8 illustrate the collapsed or retracted positions and FIGS. 3, 5 and 6, the extended positions. Note also that the retracted position of the springs is achieved without compressing or otherwise stressing the springs which thus lie in an unstressed state while retracted.

In the preferred embodiment, springs 20 each have a generally sinusoidal or wavy shape wherein all portions thereof extend substantially in the same plane. This, of course, is in contrast to conventional box springs which utilize helically or spirally coiled springs. Springs 20 may be made from any suitable spring wire, for example, 9 gauge which is bent into the desired wavy configuration. Springs 20 in the preferred embodiment shown are arranged in parallel rows. The spacing between the rows and the number and size of the springs employed may be varied as desired depending on the degree of support desired to be achieved with the box spring. Additionally, the springs may be dimensioned and spaced to produce box springs of standard sizes and depths in common use today or in other sizes.

Figure 2:
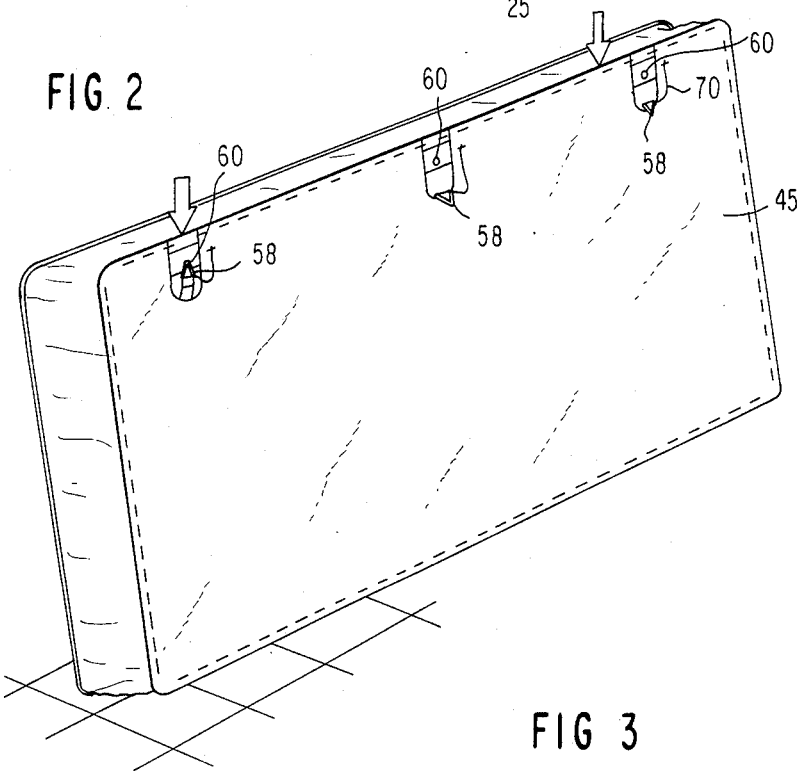
FIG. 2 is a perspective view of the box spring removed from its container and placed on edge in order to expand the box spring for use.

In the preferred embodiment, and with reference to FIGS. 5, 6 and 8, the springs are mounted to the base for movement between their extended and retracted positions. In the specific form shown, the lower end portions 20*a* of the springs are pivotally mounted to transverse base members 17 by means of staples 21 which extend about spring end portions 20*a* and are driven into frame members 17 to retain the springs while allowing pivotal movement of the springs 20. In this manner, the springs are pivotable from their erect positions where they extend in generally vertical parallel planes as shown in FIGS. 3 and 6 to their retracted positions where they are unstressed and extend in generally horizontal planes as shown in FIGS. 4 and 8. Although in the specific embodiment shown in FIGS. 1 through 8, the springs 20 are arranged to pivot in a direction transversely of the box spring between their aforementioned positions, it is also possible to alter the positions of the springs relative to the base frame so that the springs would be pivotable in the longitudinal direction of the box spring as illustrated in the embodiment of FIGS. 9 through 14. It is also possible, in other forms of the invention not shown, to arrange the springs so that some pivot transversely and others longitudinally of the box spring.

In the preferred embodiment, and with reference to FIG. 5, the upper ends 20*b* of the springs are connected to an upper frame situated below support surface generally designated 25 formed at the top of the box spring. In the preferred embodiment shown, the upper frame is provided by a rectangular wire mesh or grid generally designated 30 (FIG. 5) including longitudinally extending wires 31 and transversely extending wires 32 crossing and fixed to wires 31 in a plane generally parallel to the base frame and the support surface 25. Additionally, a rectangular border wire 34 is fixed to the grid about its perimeter. In the specific embodiment shown, the upper ends 20*b* of each of the springs 20 are pivotally connected to the longitudinally extending grid wires 31 by means of clips 36; their being two clips 36 shown connecting each of the upper spring ends 20*b* to the associated grid wire 31.

The support layer or surface 25 is placed closely adjacent to and above the grid 30; and it is also preferred that a buffer pad 40 be interposed between the layer 25 and grid 30 to minimize or avoid wear of the support surface 25. The buffer pad 40 is, of course, rectangular and extends throughout the top area of the springs. The support surface 25 is preferably made from any durable high tensile strength and flexible sheet material, for example, a polyethylene material. In the specific form shown, the support layer 25 is made as one piece with side portions 25*a* and end portions 25*b* (see FIG. 1) which envelope the springs 20 and are attached at their lower extremities 25*c* to the base members 18 and 19 as best shown in FIG. 6. A sheet 45 of fine mesh fabric or any other suitable material is preferably attached to and across the base as shown in FIGS. 2 and 5 to cover the base frame. In the preferred embodiment, the support surface 25 and the side portions 25*a* are dimensioned such that when the springs 20 are in their extended positions, the support surface 25 and side portions 25*a* will be distended into a rectangular configuration as shown in FIGS. 2 and 5.

In order to hold the springs 20 in their extended positions shown in FIGS. 3, 5 and 6, a releasable securement means or holding means is provided. In the specific embodiment shown, the holding means includes a plurality of pairs of diagonal ties 50 and 52 interconnecting the base and upper frame as best shown in FIGS. 3, 5 and 6. Ties 50 and 52 may be made from any suitable high tensile strength, flexible material such as steel or synthetic strapping. In the specific form shown, the ends of the strapping are looped at 50*a* and 52*a* and fastened by clamps 54 as shown in FIG. 6. Moreover, the upper ends of the strapping are looped about the grid and border wires 31 and 34 while the lower end of strapping 50 is looped about a fastener such as a staple 56 inserted into the base rail 18 as shown in FIG. 6. The lower end of strapping 52 is looped about an eye 58 which is receivable about a lug in the form of a screw 60 fixed in and projecting from base rail 18 as shown in FIGS. 6 and 8. It will thus be seen that with the exception of one end, each of the ends of the ties 50, 52 are permanently anchored relative to the grid and base respectively. The remaining end is releasably held about lug 60 to hold the springs 20 in their extended positions shown in FIGS. 5 and 6. This, of course, prevents movement of the box spring to the collapsed position shown in FIG. 4.

Figure 7:
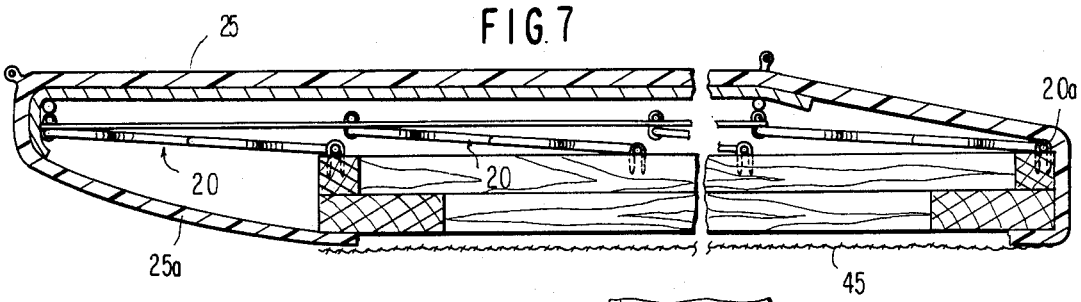
FIG. 7 is a view similar to FIG. 6 but with the box spring in the retracted or storage position.

In the preferred embodiment as best indicated in FIG. 2, three pairs of diagonal ties 50 and 52 are utilized at spaced locations along the length of the box spring. In order to release the holding effect of the ties 50, 52, the box spring is placed at the floor on its longitudinal edge at the upper frame or grid and is tilted to raise the base from the floor as illustrated in FIG. 2. Downward pressure is then exerted on the base frame in the direction of the arrow in FIG. 2 to ease the pressure of the eyes 58 on the lug 60 enabling the eyes 58 to be easily removed from the lugs 60. The upper grid frame carrying support surfaces 25 will then easily collapse relative to the base in the transverse direction of the box spring into the position of FIG. 1 wherein the box spring assumes a generally parallelogram shape as shown in FIGS. 1 and 7. During such movement, the springs 20 will pivot relative to the grid and base into generally horizontal planes as shown in FIGS. 4 and 7.

In order to give access to eyes 58 and lugs 60, the bottom sheet 45 is cut out as shown in FIG. 2 to expose the aforementioned elements. Additionally, the eyes 58 are provided with a tether 70 attached to the base at 72 (see FIGS. 2 and 8) to prevent the loose strapping 52 from falling behind the bottom sheet 45 so that the eyes 58 are always accessible after they have been removed from their associated lug 60.

In order to attach the eyes 58 about lugs 60, the same procedure described above may be followed, that is, downward pressure is applied to the base frame while the box spring is oriented as shown in FIG. 2. Once the ties 52 are attached to their lugs 60 as shown in FIG. 6, the diagonal ties 50, 52 will be tensioned to securely hold the upper grid frame spaced above the base a predetermined distance for use of the box spring. In order to reinforce the grid from the holding effect of the ties 50, 52, cross braces in the form of wires or straps (not shown) may be fixed across each of the corners of the grid wires. It is also preferred that the remainder of the grid incorporate diagonal wires between grid wires 31 and 32 to form a truss arrangement throughout the grid.

In one commercial application of the invention, the base and grid frames including the springs may be assembled as a unit and shipped in collapsed state to the box spring manufacturer who applies the outer surface pads and covering to complete the product. Of course, the entire box spring product may be made by the same manufacturer at the same place in one assembly line. When the product is completed, it is shipped to the distributor or retailer in collapsed condition which considerably increases the amount of box spring units that may be shipped per carrier, thereby decreasing unit costs significantly. Of course, unit storage costs are also significantly decreased by storing the box springs of the invention in their collapsed state.

The box springs of the invention may be packaged in cartons such as 12 shown in which event the cost of the cartons is substantially reduced. Alternatively, the box springs may be stored or shipped in their collapsed state in light, flexible sheet packing material tied with strapping to prevent movement of the base and grid frames. Other methods of packaging the box springs of the invention will no doubt become readily apparent. As many times as desired, the box springs may be moved between their use and storage positions by the manufacturer, shipper, retailer and end user or homeowner.

Referring now to FIGS. 9 through 14, there is illustrated another preferred embodiment of a box spring in accordance with the present invention. However, in this embodiment, the box spring is foldable upon itself into two overlying sections shown in FIG. 9. From the storage position shown in FIG. 9, the box spring is unfoldable into a use position shown in FIG. 10. FIGS. 9A, 9B and 9C show successive positions during movement of the box spring between the storage and use positions.

Although the support members, springs 80, of the instant embodiment are similar to those of the embodiment of FIGS. 1 through 8, the springs 80 are pivotable in the longitudinal direction of the box spring about transverse axes rather than being pivotable in the transverse direction about longitudinal axes as is the case in the embodiment of FIGS. 1 through 8.

The present embodiment also utilizes diagonal ties to secure the springs 80 in their erect, use positions, however, in contrast to the manually effected release of the ties of the above embodiment of FIGS. 1 to 8, the ties of the present embodiment are automatically tensioned and relaxed in response to movement of the box spring to the use and storage positions respectively.

The embodiment of FIGS. 9 through 14 will now be described in more detail and initially with reference to FIG. 11, it includes a rectangular base frame formed in two sections each including opposite pairs of longitudinally extending side members 82 and 83, the latter being hinged to each other to be movable about axes 84 (see FIG. 12) between storage and use positions shown in FIGS. 9 and 10 respectively. The base frame further includes opposite end members 85 and 86 extending between and fixed to side members 82 and 83 in the same plane thereof; and transversely extending members 87, 88 and 89, 90 fixed to the undersurface of side members 82 and 83 respectively. Additionally, each of the base frame sections includes a plurality of parallel runner members 91 and 92 extending longitudinally between frame members 85 and 88 and 89 and 86 respectively as best shown in FIGS. 12 and 14.

Referring to FIGS. 12 and 14, the hinges which pivotally interconnect the base frame sections include in the specific embodiment shown, a leaf 100 fixed to transverse frame member 88 and a leaf 101 fixed to transverse frame member 89. Hinge pin 88 carried by leaf 100, is journalled in ears of leaf 101 such that the base frame section including side members 83 is pivotable approximately 180° about hinge pin 84 between the positions shown in FIGS. 9 and 10. In the specific embodiment shown three hinges are employed at transversely spaced location across the juncture of the base frame sections.

Referring to FIGS. 11, 12 and 13, each of the box spring sections further includes an upper frame formed by a wire mesh or grid structure similar to that described above and including longitudinal wires 105 and 106 connected by transverse wires 107 and 108 respectively. As shown in FIG. 13, transverse wires 107 and 108 of the upper frame sections are pivotally interconnected at the juncture of the sections by means of split sleeves or clamps 109 aligned with the hinge axes 88 in the same plane thereof.

Support springs 80 have their opposite ends pivotally connected to the base and upper frames such that when the box spring is folded into the storage position shown in FIG. 1, springs 80 will pivot as illustrated in FIGS. 9 to 9C until they are retracted in generally horizontal unstressed positions generally parallel to the base and upper frames as shown in FIG. 9. In the specific embodiment shown, the lower run 80*a* of springs 80 are pivotally mounted to longitudinal base frame members 83, 92 and 82, 91 by staples 110 as shown in FIGS. 12 and 14. Note that the lower runs 80*a* of the springs lie in the same plane as the hinge pins 84 and further, at the juncture of the box spring sections are aligned with the hinge pins 84. The upper runs 80*b* of springs 80 are pivotally connected to the transverse grid wires 107, 108 by split sleeves or clamps 112.

In order to control the movement of springs 80 during folding or unfolding of the box spring as well as to secure the springs 80 in their erect, use positions shown in FIGS. 10 and 11, a system of diagonal ties is incorporated between the upper and lower frames. In the specific embodiment now being described, this system includes (see FIG. 10) three pairs of diagonal ties B and C extending diagonally longitudinally of the box spring through both sections thereof with one end of each tie being fastened to the upper frame and the opposite end to the base frame. As shown in FIG. 11, one end of tie B is secured by an eyelet 120 clamped about the endmost grid wire of the upper frame while its opposite end is secured by an eyelet 121 fixed to base frame member 87. Tie C is similarly secured by eyelets 123 and 124 to the endmost members of the upper and lower frames at diagonally opposed locations. Any flexible material of high tensile strength and durability may be used for the ties. For example, steel or plastic strapping indicated in FIG. 12 is used in the specific embodiment shown. Note from FIG. 12 that the diagonal ties B and C of each pair lie in adjacent planes between adjacent rows of springs 80.

In addition to the full length crossing ties B and C described above, the tie system further includes two diagonal ties in each box spring section. Referring to FIGS. 10, 11 and 12, the box spring section on the left-hand side includes two ties D spaced transversely of the box spring to extend in parallel diagonal paths when the box spring is in the use position of FIG. 10. One end of tie D is fixed to the inner endmost transverse grid wire of the upper frame while its other end is fixed to the outer endmost frame member 87 of the base frame.

The right hand section of the box spring as viewed in FIGS. 10, 11 and 12 similarly includes two diagonal ties whose opposite ends are fixed to the inner endmost transverse grid wire of the upper frame and the outer endmost base frame member as shown in FIG. 11. Note from FIG. 12 that the diagonal ties A and D lie in the same planes when they are taut as occurs when the box spring is in the use mode shown in FIG. 10.

When the box spring is in the folded storage position shown in FIG. 9, all of the ties A, B, C and D are relaxed and, of course, the springs 80 are retracted in unstressed condition. Initial unfolding of the upper section as illustrated in FIG. 9A will cause the springs 80 in the upper section to begin to pivot towards their erect positions while the springs 80 in the lower section remain in their fully retracted positions. In this position, all of the ties A, B, C and D will still be relaxed or under no tension. Continued unfolding will cause the springs in the upper section to become fully erect which will be determined by the diagonal tie A when it becomes taut as illustrated in FIG. 9B. When this condition is reached, the springs in the upper section will remain erect due to the taut tie A, and continued unfolding will cause the springs 80 in the lower section to unfold toward their erect positions, during which phase the slack in ties B, C and D gradually decreases (see FIG. 9C) until the fully unfolded position of FIG. 10 is reached. In this condition all of the ties A, B, C and D are taut and cooperate to secure the springs 80 in their erect positions against movement.

Upon folding of the box spring from the use position of FIG. 10 to the storage position of FIG. 9, the springs in the lower section will first move to their retracted positions while the springs in the upper section remain taut. Subsequently, slack will develop in tie A causing the springs in the upper section to retract into their folded positions.

It should be understood that although not shown in FIGS. 9 thorugh 14, the box spring will contain a suitable padding material convering the upper frame sections, and as illustrated by numeral 120 in FIG. 9, an outer case or covering of sheet material enclosing both sections on the top, sides and ends thereof as well as the bottom if desired so that the box spring may be folded and unfolded by the manufacturer, retailer or user between its use and storage positions as a finished product as many times as possible without the need of disassembling the box spring in any way.

As can be easily seen from FIG. 9, the box spring of the present invention dramatically reduces the space requirements for storage, handling and shipment while also facilitating the handling of the box spring due to its drastically reduced length and depth. Furthermore, the box spring may be easily converted from its storage to use positions and vice versa by a single person without the need of any tools or special skills.

Although the invention as shown and described is particularly suitable in the construction of box springs, it may also be applied to the construction of mattresses and other body supports with all of its attendant advantages. While the preferred embodiments disclosed incorporate resilient, spring, support members, other less resilient or even rigid support mambers may be utilized in providing various types of human body supports in accordance with the present invention.

What is claimed is:

1. A body support such as a mattress, seat or a box spring comprising in combination, a body having upper and lower frames movable relative to each other between a spaced apart use position and a storage position wherein the frames are closer together, a plurality of support members between said frames movable between retracted positions when the frames are in the storage position and erect positions when the frames are in the use position, and releasable means securing the support members in the erect positions against movement to said retracted positions and being releasable to permit said support members to move to said retracted positions for placing the frames into the storage position, said releasable means being connected to upper and lower frames in both of said use and storage positions.

2. The body support defined in claim 1 wherein said support members pivot in moving between their retracted and erect positions.

3. The body support defined in claim 2 wherein said support members interconnect said frames.

4. The body support defined in claim 3 wherein said releasable means securing the support members in the erect positions includes a pair of diagonal ties interconnected between said frames.

5. The body support defined in claim 4 wherein at least one of said ties has permanently attached thereto a connector element for releasable connection to one of said frames when the latter are in the use position.

6. The body support defined in claim 5 wherein there is further included a pad layer on the upper frame and a case of sheet material enclosing the upper frame and opposite sides and ends of the body support, and a sheet covering said lower frame and having an aperture providing access to said one of the ties for releasing or securing said one tie relative to one of the frames.

7. The body support defined in claim 1 wherein said support members are springs including wavy runs lying in generally the same plane and including bottom runs pivotally mounted to the lower frame to be movable into said erect and retracted positions, said springs extending in generally parallel planes in relaxed condition when in said retracted positions.

8. A body support such as a mattress, seat or a box spring comprising in combination, a body having upper and lower frames movable relative to each other between a spaced apart use position and a storage position wherein the frames are closer together, a plurality of support members between said frames movable between retracted positions when the frames are in the storage position and erect positions when the frames are in the use position, and releasable means including at least one yieldable tie securing the support members in the erect positions against movement to said retracted positions and being releasable to permit said support members to move to said retracted positions for placing the frames into the storage position, and wherein said releasable means securing the support members in the erect positions includes a pair of diagonal ties interconnected between said frames, and wherein said diagonal ties are made from flexible material and are relaxed when the frames are in the storage position and are taut when the frames are in the use position.

9. The body support defined in claim 8 wherein the ties extend diagonally between and are connected to opposite sides of the frames when in the use position.

10. The body support defined in claim 8 wherein the ties extend diagonally between and are connected to ooposite ends of the frames when in the use position.

11. The body support defined in claim 9 wherein said frames move laterally relative to each other when moving to said storage position.

12. The body support defined in claim 8 wherein said support members are pivotally mounted to the lower frame and pivotally connected to the upper frame.

13. The body support defined in claim 12 wherein said upper frame includes a grid including longitudinally extending wire-like members and transversely extending wire-like members interconnecting said longitudinally extending members.

14. The body support defined in claim 13 further including a pad layer on the upper frame and a case of sheet material enclosing the upper frames and opposite sides and ends of the body support.

15. A body support such as a mattress, seat or a box spring comprising in combination, a body having upper and lower frames movable relative to each other between a spaced apart use position and a storage position wherein the frames are closer together, a plurality of support members between said frames movable between retracted positions when the frames are in the storage position and erect positions when the frames are in the use position, and releasable means securing the support members in the erect positions against movement to said retracted positions and being releasable to permit said support members to move to said retracted positions for placing the frames into the storage position, and wherein said upper and lower frames each include at least two sections movable between a first position wherein the sections of each frame are generally coplanar with the support members in their erect positions and a second position wherein one of said sections lies over the other section while the support members are in said retracted positions.

16. The body support defined in claim 15 wherein said frame sections are pivotally interconnected for movement between said first and second positions thereof about upper and lower axes extending transversely of said frames.

17. The body support defined in claim 16 wherein said upper and lower frames move relative to each other in parallel planes during movement between said storage and use positions.

18. The body support defined in claim 17 wherein said support members are pivoted for movement between said erect and retracted positions about axes lying in the same plane as the lower axis of movement of said frame sections.

19. The body support defined in claim 15 wherein said releasable means securing the support members in the erect positions includes a pair of diagonal ties interconnected between said frames.

20. The body support defined in claim 19 wherein said diagonal ties are made from flexible material and are relaxed when the frames are in the storage position and are taut when the frames are in the use position.

21. The body support defined in claim 20 wherein said ties each extend through both sections of the frames.

22. The body support defined in claim 21 wherein said ties are each connected to opposite end portions of said frames at diagonally opposed locations.

23. The body support defined in claim 21 wherein said releasable means further includes additional ties each connected to diagonally opposite upper and lower frame portions of each section.

24. The body support defined in claim 23 further including a layer of sheet material enclosing the upper frame and opposite sides and ends of the body support.

25. The body support defined in claim 24 wherein said support members are springs having upper and lower runs pivotally connected to the upper and lower frames.

26. For use in bedding or seating structure, a body support comprising in combination, a base frame, a plurality of support members pivotally mounted on the base frame for pivotal movement between erect positions upstanding from the base frame and retracted positions extending generally parallel to the base frame, releasable means including at least one yieldable tie of flexible material for releasably securing said support members in said erect positions and being releasable to permit the support members to move to said retracted positions, and a cover enclosing the support members and being movable between a use position above the base frame and supported by the support members and a storage position towards the base frame when the support members are in the retracted positions.

27. The box spring defined in claim 26 wherein said base frame includes two sections pivotally interconnected for movement between a first position wherein the sections are coplanar with the support members in the erect positions and a second position wherein one section overlies the other section with the support members in the retracted position.

28. For use in bedding or seating structure, a body support including means for folding the body support upon itself from a use position into at least two overlying sections thereby decreasing a length of the body for purposes of storage or handling, said body support including a plurality of support members, said body further having means to retract the support members in response to folding of the body support upon itself to decrease a length of the body.

29. The body support defined in claim 28 wherein said support members are movable to erect positions in response to unfolding of the body support into the use position.

30. The body support defined in claim 29 wherein said support members are mounted in the body support for pivotal movement between said retracted and erect positions.

31. The body support defined in claim 30 including a lower frame and wherein said support members are pivotally mounted to said lower frame.

32. The body support defined in claim 31 including an upper frame and wherein said support members are pivotally connected to said upper frame.

33. The body support defined in claim 30 further including upper and lower frames and wherein said support members are pivotally connected to both of said frames for movement between said erect and retracted positions thereof.

34. The body support defined in claim 33 further including means for securing the support members in their erect positions and being releasable upon folding of the body support upon itself.

35. The body support defined in claim 28 further including means for securing the support members in their erect positions and being releasable upon folding of the body support upon itself.

36. The body support defined in claim 34 wherein said means for securing said support members includes diagonal ties of flexible material and each extending between said frames and being connected to the frames at diagonally opposed locations.

37. For use in bedding or seating structure, a body support structure including first and second portions each including base frames movable between a first position wherein the base frames extend generally in the same plane and a second position wherein one of said base frames overlies the other base frame, said portions including support members mounted to the base frames to be movable between erect and retracted positions said body further having means to erect and retract the support members in response to movement of said portions between said first and second positions, respectively.

38. The body support structure defined in claim 37 wherein said first and second portions are pivotally interconnected to move between said first and second positions thereof.

39. The body support structure defined in claim 37 wherein said first and second portions are pivotally interconnected to move between said first and second positions thereof.

40. The body support structure defined in claim 39 wherein said support members are pivotally mounted to the base frames for movement between said erect and retracted positions.

41. For use in bedding or seating structure, a body support including upper and lower sections each including first and second portions movable between a first position wherein the portions of each section extend generally in the same plane and a second position wherein one of said portions of each section overlies the other portion of that section and the length of said body is reduced, said body support including collapsible support means, and means for collapsing said support means in response to movement of said portions into said second position thereof.

42. A body support for use in bedding or seating structures comprising in combination, a body having upper and lower frames movable relative to each other between a spaced apart use position and a storage position wherein the frames are closer together, a plurality of support members between said frames movable between retracted positions when the frames are in the storage position and erect positions when the frames are in the use position, and means securing the support members in the erect positions against movement to said retracted positions and being releasable upon movement of one frame relative to the other frame to permit said support members to move to said retracted positions for placing the frames into the storage position, said means being connected to the upper and lower frames in both the use and storage positions.

43. A body support for use in bedding or seating structure comprising in combination, a body having upper and lower frames movable relative to each other between a spaced apart use position and a storage position wherein the frames are closer together, a plurality of support members between said frames movable between retracted positions when the frames are in the storage position and erect positions when the frames are in the use position, and releasable means securing the support members in the erect positions against movement to said retracted positions and being releasable to permit said support members to move to said retracted positions for placing the frames into the storage position, said releasable means including at least one member interconnecting said upper and lower frames in both of said use and storage positions.

44. For use in bedding or seating structure, a body support structure comprising in combination, a body including upper and lower sections each including first and second portions movable between a first position wherein the portions of each section extend generally in the same plane and a second position wherein one of said portions of each section overlies the other portion of that section, said body including support members movable between erect and retracted positions said body further having means to erect and retract the support members in response to movement of said portions between first and second positions, respectively.

45. For use in bedding or seating structure, a body support structure comprising in combination, a body including upper and lower sections each including first and second portions movable between a first position wherein the portions of each section extend generally in the same plane and a second position wherein the portions of each section extend in different planes, said body including support members movable between erect and retracted positions said body further having means to erect and retract the support members in response to movement of said portions between said first and second positions, respectively.

46. The body support structure defined in claim 45 wherein said support members are mounted for pivotal movement between said erect and retracted positions thereof.

47. The body support structure defined in claim 46 including means pivotally interconnecting said first and second portions to move between said first and second positions thereof.

48. The body support defined in claim 47 wherein said support members each include wire-like element lying in a generally vertical plane when the said first and second portions are in said second position.

49. The body support defined in claim 45 wherein said support members each include wire-like element lying in a generally vertical plane when the said first and second portions are in said second position.

50. A body support for use in bedding or seating structure, the body support comrising in combination, a body, means for moving the body upon itself into at least two sections thereby decreasing a length of the body for storage or handling, and said body including a plurality of support members, said body further having means to retract the support members in response to movement of the body upon itself to decrease a length of the body, said body having means to move said support members into erect positions wherein said body support has a first length and said retracted positions wherein said body support has a second length shorter than said first length.

51. The body support defined in claim 50 wherein said support members are mounted for pivotal movement in said body.

52. The body support defined in claim 50 wherein said support members include a plurality of wire-like elements including portions lying in the same plane.

53. A body support for use in bedding or seating structures comprising in combination, a body having upper and lower frames, support means located between said frames and movable between retracted and extended positions, each of said frames having first and second portions movable between a first position wherein said portions of each frame generally overlie each other and hold said support means in said retracted position for storing or handling, and a second position wherein said portions of each frame extend generally in the same plane and said support means are in said extended position for use said body support having means to erect the support members in response to movement of said portions to the second position.

* * * * *